United States Patent [19]

Suzuki

[11] 4,012,980

[45] Mar. 22, 1977

[54] CONTROL CIRCUITRY FOR A VOLTAGE-CONTROLLED TYPE ELECTRONIC MUSICAL INSTRUMENT

[75] Inventor: Tutomu Suzuki, Maisaka, Japan

[73] Assignee: Nippon Gakki Seizo Kabushiki Kaisha, Japan

[22] Filed: Nov. 26, 1975

[21] Appl. No.: 635,376

[30] Foreign Application Priority Data

Nov. 27, 1974 Japan ..... 49-143582

[52] U.S. Cl. ..... 84/1.01; 84/DIG. 2; 84/DIG. 20; 84/DIG. 23

[51] Int. Cl.[2] ..... G10H 1/00; G10H 5/02

[58] Field of Search ..... 84/1.01, 1.11, 1.19, 84/1.24, DIG. 2, DIG. 7, DIG. 8, DIG. 9, DIG. 20, DIG. 23

[56] References Cited

UNITED STATES PATENTS

| | | | |
|---|---|---|---|
| 3,715,444 | 2/1973 | Pearlman | 84/1.01 |
| 3,781,450 | 12/1973 | Nakajima | 84/1.01 |
| 3,828,110 | 8/1974 | Colin | 84/1.01 |
| 3,861,263 | 1/1975 | Okudaira | 84/1.11 |
| 3,872,764 | 3/1975 | Munch, Jr. et al. | 84/1.01 |
| 3,886,834 | 6/1975 | Okamoto | 84/1.19 X |
| 3,886,836 | 6/1975 | Hiyoshi | 84/1.19 X |
| 3,897,709 | 8/1975 | Hiyoshi et al. | 84/1.19 |
| 3,902,392 | 9/1975 | Nagahama | 84/1.01 |
| 3,902,396 | 9/1975 | Hiyoshi | 84/1.19 |
| 3,922,943 | 12/1975 | Niinomi | 84/1.19 X |

*Primary Examiner*—Stanley J. Witkowski
*Attorney, Agent, or Firm*—Flynn & Frishauf

[57] ABSTRACT

This invention discloses control circuitry for an electronic musical instrument including a keyboard, a voltage divider circuit coupled to the keyboard to provide a pitch determining voltage signal corresponding to a depressed key, a storage capacitor for storing the pitch determining voltage signal, voltage-controlled tone signal generating means responsive to the pitch determining voltage signal and adapted to produce a tone signal corresponding to the depressed key, and control voltage waveform generating means responsive to a trigger signal and adapted to produce a control voltage waveform which is coupled to the voltage-controlled tone signal generating means so as to control the tone signal to be generated thereby. The control circuitry includes a first and a second gate means both coupled in series between the voltage divider circuit and the storage capacitor, and circuit means coupled to the voltage divider circuit so as to provide the trigger signal for the control voltage waveform generating means and first and second gate signals which are coupled to, and adapted to enable, respectively the first and second gate means.

9 Claims, 5 Drawing Figures

CONTROL CIRCUITRY FOR A VOLTAGE-CONTROLLED TYPE ELECTRONIC MUSICAL INSTRUMENT

BACKGROUND OF THE INVENTION

This invention relates to control circuitry for an electronic musical instrument of a voltage-controlled type, that is, of a synthesizer type.

In a synthesizer type electronic musical instrument provided with means for generating control voltage waveforms and with voltage-controlled tone signal generating means including a voltage-controlled oscillator (hereinafter abbreviated as VCO), a voltage-controlled filter (hereinafter abbreviated as VCF) and a voltage-controlled amplifier (hereinafter abbreviated as VCA), for instance, a pitch determining voltage signal or first signal corresponding to the note of a key actuated on the keyboard and a trigger signal or second signal indicating the key actuation are coupled to the voltage-controlled tone signal generating means and the control voltage waveform generating means, respectively. Such an electronic musical instrument of a synthesizer type has a voltage divider network for producing the first signal which corresponds to the note of an actuated key and a storage capacitor for storing the first signal.

The conventional synthesizer type electronic musical instrument has a first group of key switches actuated by many keys on the keyboard in order to produce the first signal and a second group of key switches actuated also by many keys in order to produce the second signal. The provision of two key switch groups, however, apparently makes it difficult to enhance the reliability of the electronic musical instrument.

It is required of a synthesized type electronic musical instrument to produce musical sounds, even after the key-release, in accordance with control voltage waveforms. The storage capacitor should therefore retain the pitch determining signal for some time after the key-release.

SUMMARY OF THE INVENTION

Accordingly the object of this invention is to provide control circuitry for an electronic musical instrument of a synthesizer type in which a single group of key switches serve to produce both a pitch determining voltage signal and a trigger signal and the voltage on the storage capacitor can be preserved after the key-release.

The embodiment of this invention is provided with a first and a second gate coupled in series between a storage capacitor and a voltage divider circuit coupled to the keyboard to provide a pitch determining voltage signal and with circuit means coupled to the voltage divider circuit so as to produce, according to the voltage variation of the output of the voltage divider circuit, first and second gate signals which enable respectively the first and second gates and a trigger signal which causes control waveform generators to generate a control voltage waveform.

DETAILED DESCRIPTION OF THE PREFERRED EMBODIMENTS

Figure 1:
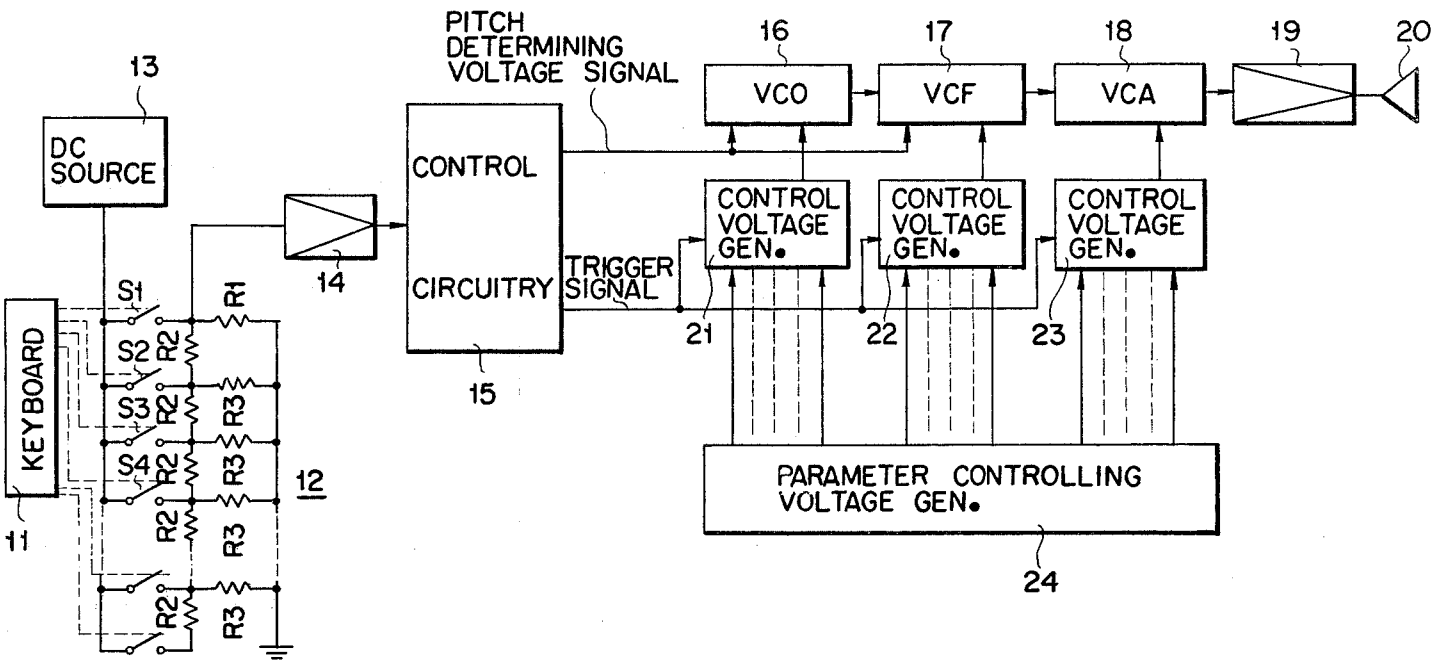
FIG. 1 is a block diagram of an electronic musical instrument embodying this invention.

In FIG. 1, reference numeral 11 denotes a keyboard with a plurality of keys. To the keyboard 11 there is coupled a voltage divider circuit 12 for generating a pitch determining voltage signal having a voltage value corresponding to the note of an actuated key. The voltage divider circuit 12 is provided with a constant D.C. voltage source 13, a voltage dividing ladder network constituted by resistors R1, R2 and R3 and key switches S1, S2, S3, . . . coupled between the constant D.C. voltage source 13 and the respective nodes of the voltage dividing ladder network. Among the resistors R1, R2 and R3 is the following resistance relationship:

$$\frac{R2}{R1} = 2^{\frac{1}{12}} - 1$$

$$\frac{R2}{R3} = 2^{\frac{1}{12}} + 2^{-\frac{1}{12}} - 2$$

The output of the voltage divider circuit 12 is coupled through a buffer amplifier 14 which may have, for example, a gain of unity to a control circuitry 15. The control circuitry 15 produces a pitch determining voltage signal to be coupled to a VCO 16 and a VCF 17 and a trigger signal to be coupled to control voltage waveform generators 21, 22 and 23 which are adapted to generate control voltage waveforms to be coupled to the VCO 16, the VCF 17 and a VCA 18, respectively. The output of the VCA 18 is coupled to an amplifier 19 followed by a loudspeaker 20.

Figure 4A:
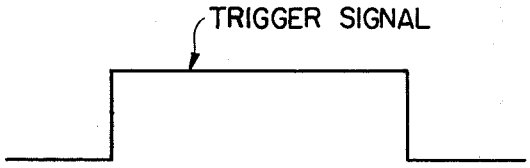
FIGS. 4A and 4B show, respectively, the waveform of a trigger signal and a control voltage waveform.
Figure 4B:
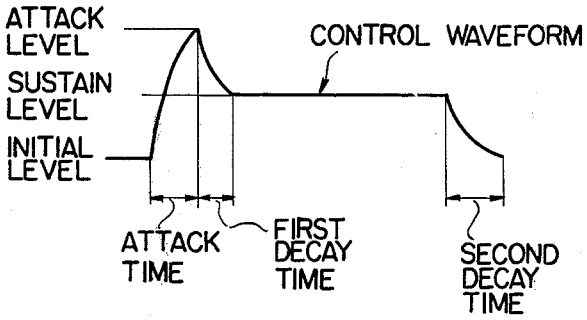

The control voltage waveform generators 21, 22 and 23 form control voltage waveforms in response to the trigger signal from the control circuitry 15. The control voltage waveform generators 21 and 22 produce, in response to the trigger signal as shown in FIG. 4A, such control voltage waveforms, for instance, as illustrated in FIG. 4B. These control voltage waveforms rise up in an attack time period from an initial level to an attack level and decay in a first decay time period from the attack level down to the sustain level, which is retained until the trigger signal becomes extinct and then is lowered to the initial level in a second decay time period. In this manner the voltage of the control voltage waveforms formed by the waveform generators 21 and 22 varies as a function to time. The control voltage waveform generator 23, which is associated with the VAC 18, forms a similar control voltage waveform. As long as the control voltage waveform is not supplied, the VAC 18 remains in cutoff state.

The control voltage waveform generators 21, 22 and 23 may be so constituted as to be controlled with voltage signals so that the various parameters of the resultant waveforms can be varied. To achieve this object, they are so designed as to receive parameter controlling voltage signals from a parameter controlling voltage generator 24.

Figure 2:
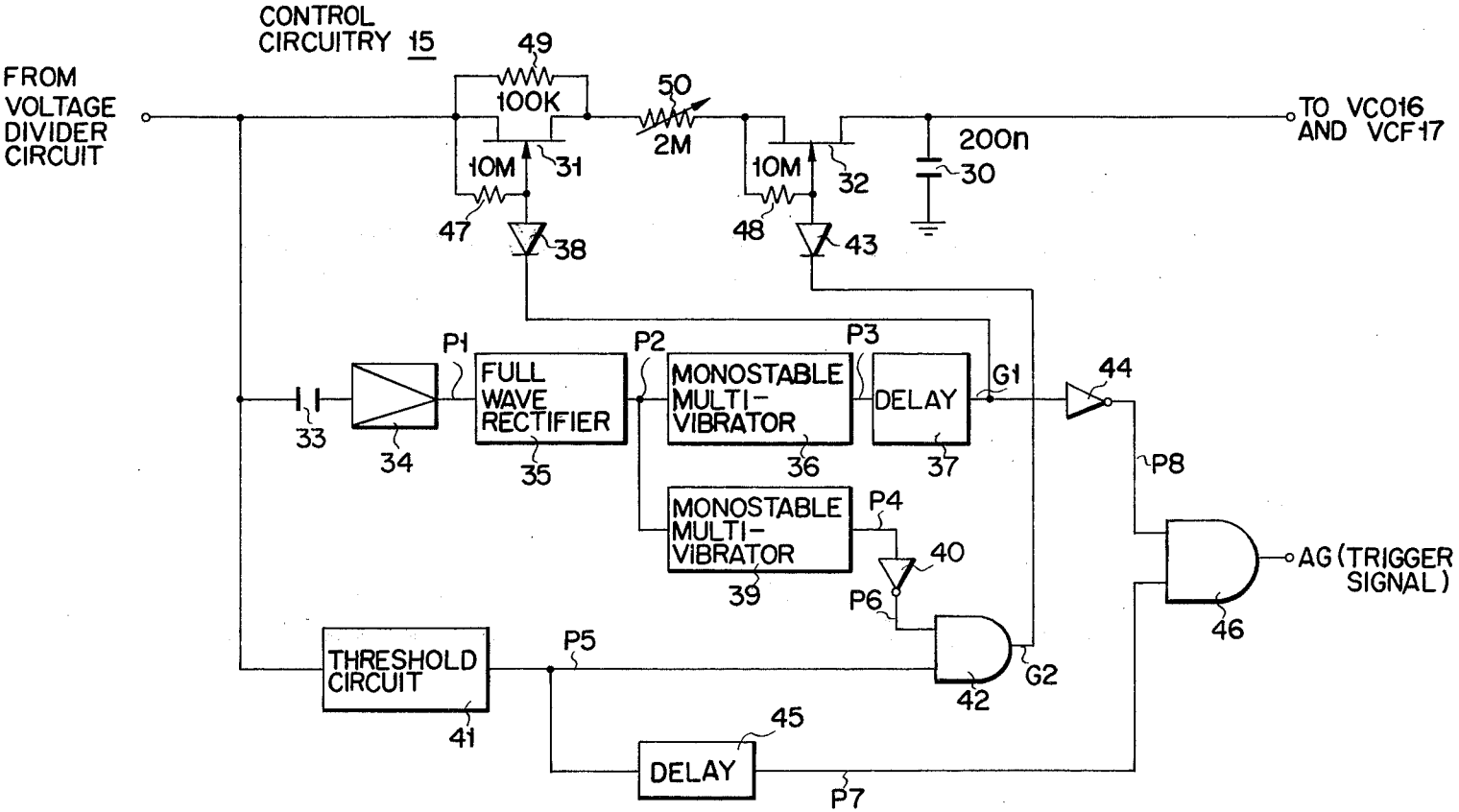
FIG. 2 is a block diagram of the control circuitry in the electronic musical instrument of FIG. 1.

As shown in FIG. 2, the pitch determining voltage signal from the voltage divider circuit 12 is coupled to a storage capacitor 30 through first and second gate means 31 and 32. The storage capacitor 30 holds a third signal proportionate in voltage level to the pitch determining voltage signal. The third signal is coupled to the VCO 16 and VCF 17. In response to the third signal the VCO 16 generates a tone signal having a frequency corresponding to the note of the key depressed at the keyboard 11. At the same time, the third signal is coupled also to the VCF 17 so that the cut-off frequency of the VCF 17 may be shifted according to the note of the depressed key.

The output voltage signal of the voltage divider circuit 12 is coupled to a capacitor 33 and then to an amplifier 34, which detect the voltage variation at the key-depression and key-release and produces differential outputs P1. The differential outputs P1 are supplied to a full wave rectifier 35. In response to the differential outputs P1 the full wave rectifier 35 produces outputs P2, each of which triggers a first monostable multivibrator 36. When triggered, the first monostable multivibrator 36 forms rectangular wave outputs P3 each having a first duration of, for example, 10 ms. Each rectangular wave output P3 is delayed by a first delay circuit 37 for a predetermined time, for example 3ms to provide a first gate signal G1 which is to enable the first field effect transistor 31. The first gate signal G1 is coupled to the gate or control electrode of the field effect transistor 31 through a diode 38.

The outputs of the full wave rectifier 35 are also coupled to a second monostable multivibrator 39, which form rectangular wave outputs P4 each having a second duration of, for example, 5 ms. These rectangular wave outputs P4 are supplied to an inverter 40.

The output voltage signal of the voltage divider circuit 12 is supplied also to a Schmitt circuit or threshold circuit 41. The threshold circuit 41 provides an output voltage P5 while it is applied with the output voltage from the voltage divider circuit 12, that is, while a key is depressed at the keyboard 11. The output P5 of the threshold circuit 41 and the output P6 of the inverter 40 cooperate to cause an AND gate 42 to produce a second gate signal G2 to enable the second gate or field effect transistor 32. The second gate signal G2 is coupled through a diode 43 to the gate or control electrode of the second field effect transistor 32.

The first gate signal G1 is inverted by another inverter 44 to form an output P8. The output P5 of the threshold circuit 41 is delayed by a second delay circuit 45 for a predetermined time, for example, 5 ms. This delay time is selected to range from the delay time defined by the first delay circuit 37 to the sum of the delay time of the first delay circuit and the first duration of the rectangular output P3 from the first monostable multivibrator 16. The output P7 of the second delay circuit 45 and the output P8 of the inverter 44 are supplied to an AND gate 46 to produce a trigger signal AG.

There are connected biasing resistors 47 and 48 respectively between the gate electrodes of the field effect transistors 31 and 32 and between the source electrodes thereof. In parallel to the source-to-drain path of the first field effect transistor 31 a resistor 49 is connected. there is connected between these transistors 31 and 32 a variable resistor 50 for providing portamento effect.

Figure 3:
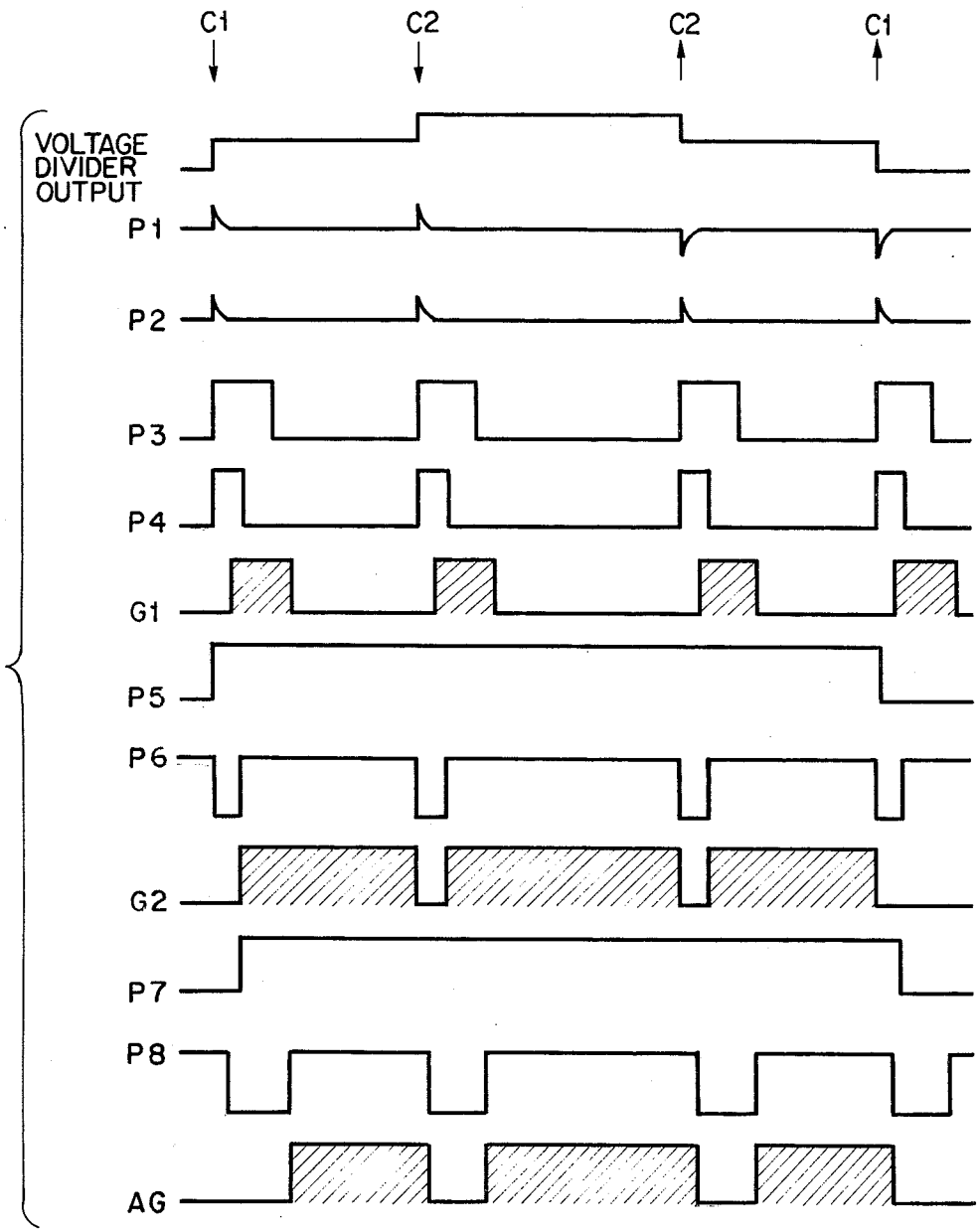
FIG. 3 shows the voltage waveforms at the various parts of the control circuitry of FIG. 2.

It shall now be explained how the control circuitry of FIG. 2 functions, with reference to FIG. 3.

The voltage divider circuit 12 is of, for instance, a higher tone preference type. Suppose a key C1 and a key C2 are depressed sequentially, and the key C2 and then the key C1 are released. Then, the output voltage of the voltage divider circuit 12 varies as illustrated in FIG. 3. In consequence of this the output P1 of the amplifier 34 contains positive- and negative-going spikes which correspond respectively to the positive and negative transitions of the output voltage of the voltage divider circuit 12. The negative-going spikes of the output P1 are inverted by the full wave rectifier 35, so that the output P1 is transformed into an output P2 containing positive-going spike pulses only. Each positive-going spike pulse of the output P2 triggers the first multivibrator 36, which produces a rectangular wave output P3 having a duration of about 10 ms. The rectangular wave output P3 is delayed for about 3 ms by the first delay circuit 37 and thus transformed into a first gate signal G1. In response to the first gate signal G1, the first gate 31 is rendered conductive about 3 ms after the key-depression or the key-release. The first gate 31 remains conductive for about 10 ms. The 3 ms-delay is intended to enable the first gate 31 after completion of the key switch chattering.

The output P2 of the full wave rectifier 35 triggers the second monostable multivibrator 39. When triggered, the multivibrator 39 produces a rectangular wave output P4 having a duration of about 5 ms. The rectangular wave output P4 is inverted by the first inverter 40 and thus becomes an inverted output P6. The output voltage of the voltage divider circuit 12 is supplied also to the threshold circuit 41. In response to the output voltage threshold circuit 41 produces an output P5. These outputs P5 and P6 are coupled to the AND gate 42. Upon receipt of the outputs P5 and P6, the AND gate 42 produces a second gate signal G2 which is to enable the second gate 32. The second gate signal G2 rises after a relatively short time from the rising of the first gate singal G1 and terminates at the release of the key C1 or the depression of the key C2. By contrast, the first gate signal G1 lasts for a relatively short time and terminates usually before the key-depression or the key-release.

While both the first and second gates 31 and 32 remain conductive, the output voltage of the voltage divider circuit 12 is coupled to the storage capacitor 30. Accordingly, the storage capacitor 30 is charged for a relatively very short time. The first gate 31 becomes non-conductive earlier than the second gate 32. If the storage capacitor 30 is charged insufficiently at this time, the output voltage from the voltage divider circuit 12 is further charged in the storage capacitor 30 through the resistor 49 connected parallel to the first gate 31. Upon the key-release the second gate signal G2 terminates, thus rendering the second gate 32 non-conductive. As a result, the unwanted discharge of the storage capacitor 30 is prevented from occurring through, for example, the resistor 49. For this reason the voltage of the storage capacitor 30 can be maintained even after the key-release. To prevent the discharge of the storage capacitor 30 which may occur through the resistor 49, the second gate signal G2 is made to rise after the rising of the first gate signal G1.

When the storage capacitor 30 is charged sufficiently, that is, at the termination of each first gate signal G1, the trigger signal AG starts and terminates after a relatively short time from the termination of each second gate signal G2. Delaying the output P5 of the threshold circuit 41 by the delay circuit 45 to obtain the trigger signal AG is intended not to generate the trigger signal AG before the rising of the second gate signal G2.

If the key-operation proceeds as shown in FIG. 3 at normal speed, the tone of the key C1 is voiced first, then the tone of the key C2 is voiced, and again the tone of the key C1 is voiced even after the release of the key C2 until the key C1 is released.

What is claimed is:

1. In an electronic musical instrument comprising a keyboard having a plurality of keys; voltage divider circuit means coupled to said keyboard and adapted to provide a first signal which has a voltage value corresponding to a depressed key; control circuitry coupled to said voltage divider circuit means and providing a second signal indicative of the depression of the key and a third signal which is a function of said first signal; a storage means coupled to said control circuitry for storing said third signal; voltage-controlled tone signal generating means coupled to said storage means and adapted to produce a tone signal corresponding to the depressed key; and control voltage signal generating means coupled to said control circuitry and adapted to receive said second signal and to produce a control voltage signal the voltage of which varies as a function of time, the control voltage signal being coupled to said voltage-controlled tone signal generating means so as to control the tone signal to be generated thereby;

said control circuitry comprising:

a first gate means coupled to said voltage divider circuit means and having a first control electrode, said first gate means being rendered conductive in response to application of a first gate signal to said first control electrode;

a second gate means coupled between said first gate means and said storage means and having a second control electrode, said second gate means being rendered conductive in response to application of a second gate signal to said second control electrode; and circuit means coupled to said voltage divider circuit means and responsive to voltage variation at the output of said voltage divider circuit means so as to provide the second signal for said control voltage generating means and the first and second gate signals for said first and second gate means, respectively.

2. An electronic musical instrument according to claim 1 wherein said circuit means provides the first gate signal after a relatively short time from the depression of a key and terminates the first gate signal before the release of the key, provides the second gate signal after a relatively short time from the occurrence of the first gate signal and terminates the second gate signal upon the release of the key, and provides the second signal upon the termination of the first gate signal and terminates the second signal after a relatively short time from the termination of the second gate signal.

3. An electronic musical instrument according to claim 1 wherein said circuit means comprises a differentiating means coupled to said voltage divider circuit means and responsive to a voltage variation thereof so as to provide an impulse; a first monostable multivibrator coupled to receive the impulse so as to produce a first output pulse having a first duration; a first delay means coupled to said first monostable multivibrator and adapted to delay the first output pulse so as to provide the first gate signal; a second monostable multivibrator coupled to receive the impulse so as to produce a second output pulse having a second duration; a threshold circuit means coupled to said voltage divider circuit means and responsive to the presence of the output voltage of said voltage divider circuit means so as to produce an output signal; first logic circuit means coupled to the outputs of said second monostable multivibrator and said threshold circuit means and adapted to produce the second gate signal; a second delay means coupled to said threshold circuit means and adapted to delay the output signal of said threshold circuit means; and second logic circuit means coupled to the outputs of said first and second delay means and adapted to provide the second signal.

4. An electronic musical instrument according to claim 3 wherein the first duration of the first output pulse is longer than the second duration of the second output pulse; and a second delay time provided by said second delay means ranges from a first delay time provided by said first delay means to the sum of the first duration and the first delay time.

5. An electronic musical instrument according to claim 1 further comprising a resistor means coupled between said first and second gate means.

6. An electronic musical instrument according to claim 5 wherein said resistor means is a variable resistance resistor means.

7. An electronic musical instrument according to claim 1 further comprising a resistor means coupled in parallel with said first gate means.

8. An electronic musical instrument according to claim 1 wherein said third signal provided by said control circuitry is proportional to said first signal.

9. An electronic musical instrument according to claim 1 wherein said storage means comprises a storage capacitor.

* * * * *